US006797896B2

(12) United States Patent
Lee

(10) Patent No.: US 6,797,896 B2
(45) Date of Patent: Sep. 28, 2004

(54) NAVIGATION SWITCH ASSEMBLY

(75) Inventor: Ui-jin Lee, Gyunggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/421,766

(22) Filed: Apr. 24, 2003

(65) Prior Publication Data

US 2004/0000467 A1 Jan. 1, 2004

(30) Foreign Application Priority Data

Jun. 28, 2002 (KR) ..... 2002-37118

(51) Int. Cl.[7] ..... H01H 9/00
(52) U.S. Cl. ..... 200/6 A; 200/335; 200/336
(58) Field of Search ..... 200/4, 5 R, 6 A, 200/17 R, 18, 332, 335, 336; 345/161

(56) References Cited

U.S. PATENT DOCUMENTS 6,360,622 B1 * 3/2002 Shibata ..... 73/866.1
6,448,957 B1 * 9/2002 Chia-Hung ..... 345/161
6,613,990 B2 * 9/2003 Kawasaki ..... 200/6 A
6,636,197 B1 * 10/2003 Goldenberg et al. ..... 345/156
6,667,733 B2 * 12/2003 Miyoshi ..... 345/156
6,724,369 B2 * 4/2004 Slotta ..... 345/161

* cited by examiner

*Primary Examiner*—Michael A. Friedhofer
(74) *Attorney, Agent, or Firm*—Staas & Halsey LLP

(57) ABSTRACT

A navigation switch assembly includes a navigation switch secured to a printed circuit board disposed in a product casing and having an adjustment stick protruding from an upper portion thereof; a knob connected to the upper portion of the navigation switch; a holder connected to the knob in the product casing, preventing the knob from being separated outwardly from the product casing; and a connecting portion for connecting the knob and the holder. The connecting portion includes a pair of guide grooves each having a vertical guide groove and a horizontal guide groove connected to an end of the vertical guide, the guide grooves being formed along an external circumference of a hollow shaft disposed at a lower end of the knob, each pair being opposed to each other, a pair of locking grooves having horizontal shapes; a pair of ribs formed on an inner surface of the holder and being opposed to each other and protruding from the holder toward a center; and a pair of tension ribs protruding from the holder along a circumferential direction with a long length and having a locking protrusion formed at an end thereof.

10 Claims, 5 Drawing Sheets

NAVIGATION SWITCH ASSEMBLY

CROSS-REFERENCE TO RELATED APPLICATIONS

This application claims the benefit of Korean Application No. 2002-37118, filed Jun. 28, 2002, in the Korean Intellectual Property Office, the disclosure of which is incorporated herein by reference.

BACKGROUND OF THE INVENTION

1. Field of the Invention

The present invention relates to a navigation switch assembly, and, more particularly, to a navigation switch assembly for allowing a user to change and select a desired user environment for using an information apparatus.

2. Description of the Related Art

Generally, a navigation switch assembly can be employed in every electronic product, but is mainly used for compact-type wireless apparatuses such as a PDA, a notebook, an Internet terminal, and a remote controller.

As shown in FIG. 1, a conventional navigation switch assembly includes a navigation switch 82 mounted on a printed circuit board (PCB) 80 and having an adjustment stick 83 disposed on an upper portion thereof, and a knob 84 having a pressing plate 81, which a user presses to change a screen.

Along a circumference of the knob 84 is formed a wing part 85, and in a lower portion of the knob 84 is formed a stick inserting hole 84*a*. The adjustment stick 83 protruding from the upper portion of the navigation switch 82 is inserted into the stick inserting hole 84*a*.

Hereinafter, descriptions will be made about a process of assembling the conventional navigation switch assembly as constructed above.

The navigation switch 82 secured to the PCB 80 is mounted in a product casing 86, and then the knob 84 having the wing part 85 is placed to be fitted with the adjustment stick 83 protruding from the upper portion of the navigation switch 82, and finally the product casing 86 is assembled with the knob 84 being fitted in a mounting hole 87.

As shown in FIG. 1, in the conventional navigation switch assembly assembled according to the above-described process, because the wing part 85 is caught in the product casing 86, the knob 84 is prevented from being removed from the product casing 86 to the outside even if a user pulls the knob 84 out of the product casing 86.

As above, the knob 84 is required to have the wing part 85 formed along the circumference of the knob 84 in order to prevent the knob 84 from separating from the product casing to the outside. Due to the presence of the wing part 85, the product casing inevitably has to be assembled in the final step of the assembly processing. Also there is a limit to the size of the upper end of the knob 84, i.e., the upper end of the knob 84 should not be larger than the mounting hole 87 opening formed in the upper side of the product casing.

Also, since the conventional navigation switch assembly is not allowed to variously change the design of the knob, it cannot be harmonious with the design of a product employing the navigation switch assembly. That is, it has been deemed in the field of the related art that there is a limitation of the design.

SUMMARY OF THE INVENTION

The present invention has been developed in order to solve the above problems in the related art. Accordingly, it is an aspect of the present invention to provide a navigation switch assembly allowing a knob to vary in its appearance or design.

Another aspect of the present invention is to provide a navigation switch assembly having a connecting portion for easy connection and separation of a knob and a holder such that the knob is fixedly connected to the holder and the knob is not separated from a product casing in operation.

Additional objects and advantages of the invention will be set forth in part in the description which follows and, in part, will be obvious from the description, or may be learned by practice of the invention.

The foregoing aspects are realized by providing a navigation switch assembly, comprising: a navigation switch assembly, comprising: a navigation switch mounted on a printed circuit board, comprising: an adjustment stick protruding from an upper portion thereof; a knob, comprising: a first connecting portion; and a holder, comprising: a second connecting portion; wherein the first connection portion is to connect to the second connecting portion, and the first connecting portion is to connect to the adjustment stick.

In an embodiment, the navigation switch further comprises: a product casing, comprising: an opening through which the first connecting portion passes to connect to the second connecting portion.

In an embodiment, the holder is larger than the opening and an upper portion of the knob is larger than the opening.

In an embodiment, the casing is shaped to have a concave surface formed around the opening, and a height of the knob is equal to that of a surface other than the concave surface.

In an embodiment, the casing is shaped to have a concave surface formed around the opening, and a height of the knob is higher than that of a surface other than the concave surface.

In an embodiment, the knob further comprises a pressing plate to press the knob towards the switch to activate the switch, wherein the pressing plate comprises a friction opening to prevent sliding.

In an embodiment, the first connecting portion comprises: a pair of guide grooves and a pair of locking grooves, each pair being formed along an external circumference of a hollow shaft disposed at a lower end of the knob; and the second connecting portion comprises: a pair of ribs and a pair of tension ribs, each pair being formed along an inner surface of the holder.

In an embodiment, each of the guide grooves has a vertical guide groove and a horizontal guide groove connected to an end of the vertical guide groove; each of the locking grooves has a vertical shape; each of the ribs protrudes from the holder toward a center; each of the tension ribs protrudes from the holder along a circumference direction with a long length and has a locking protrusion formed at an end thereof; and the hollow shaft is fitted in the holder in a vertical direction such that the ribs are inserted into the vertical guide grooves and then the holder is rotated in a circumferential direction such that the ribs are moved to the horizontal guide grooves simultaneously with the locking protrusion being connected with the locking grooves.

In an embodiment, the connecting portion comprises: a pair of guide grooves and a pair of locking grooves, each pair being formed along an external circumference of a hollow shaft disposed at a lower end of the knob, each of each pair being opposed to the other of the pair; and a pair of ribs and a pair of tension ribs, each pair being formed along an inner surface of the holder, each of each pair being opposed to the other of the pair.

In an embodiment, each of the guide grooves has a vertical guide groove and a horizontal guide groove connected to an end of the vertical guide groove, each of the locking grooves has a vertical shape, each of the ribs protrudes from the holder toward a center, each of the tension ribs protrudes from the holder along a circumferential direction with a long length and has a locking protrusion formed at an end thereof, the hollow shaft is fitted in the holder in a vertical direction such that the ribs are inserted into the vertical guide grooves and then the holder is rotated in a circumferential direction such that the ribs are moved to the horizontal guide grooves simultaneously with the locking protrusion being connected with the locking grooves.

In the navigation switch assembly according to an embodiment of the present invention, there is no reason to assemble the product casing in the final step of the assembly process because the knob and the holder are fabricated and assembled with each other separately from the product casing and the knob does not have a wing part like the conventional art. That is, after simply inserting the hollow shaft disposed at the lower portion of the knob into the product casing through the mounting portion, the knob is connected to the holder in the product casing. Accordingly, a shape of the knob can be designed in various ways regardless of the size and shape of the mounting opening of the product casing.

Also, by using the connecting portion for easy connection and separation, the present invention can provide a firm navigation switch assembly and prevent the knob from being separated from the product casing during operation.

BRIEF DESCRIPTION OF THE DRAWINGS

These and other aspects and advantages of the present invention will become more apparent and more readily appreciated from the following description of the embodiments of the present invention, taken in conjunction with the accompanying drawings of which.

DETAILED DESCRIPTION

Figure 1:
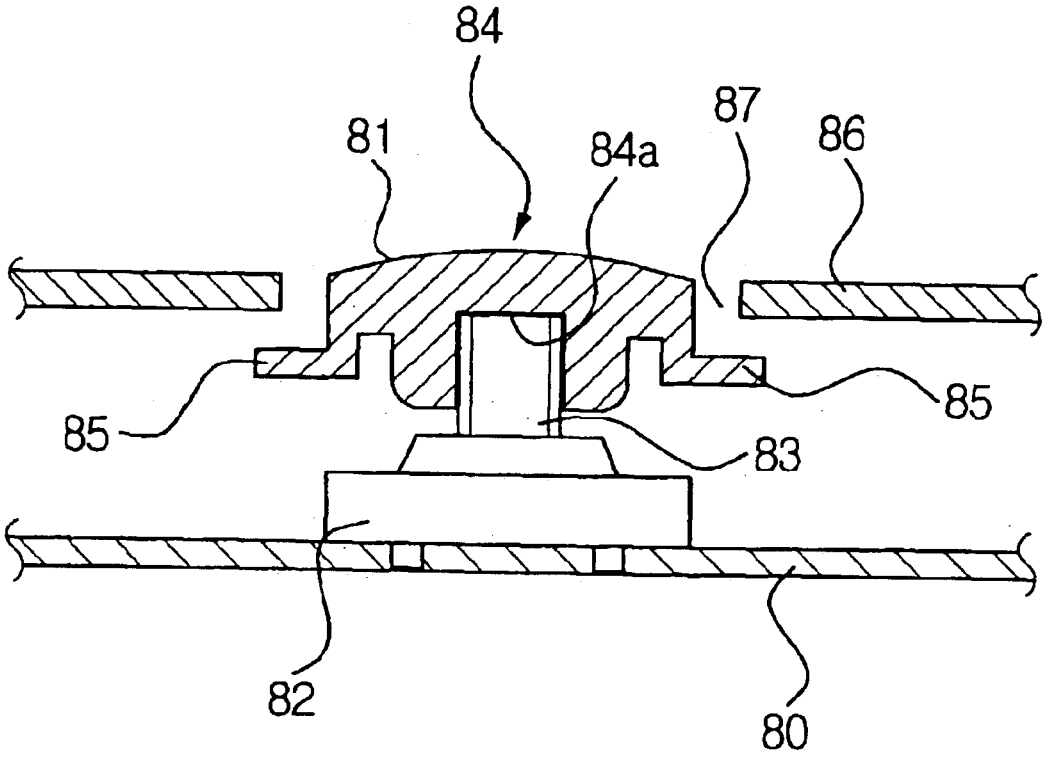
FIG. 1 (PRIOR ART)
FIG. 1 is a section view showing a conventional navigation switch assembly.

Reference will now be made in detail to the embodiments of the present invention, examples of which are illustrated in the accompanying drawings, wherein like reference numerals refer to like elements throughout.

Figure 2:
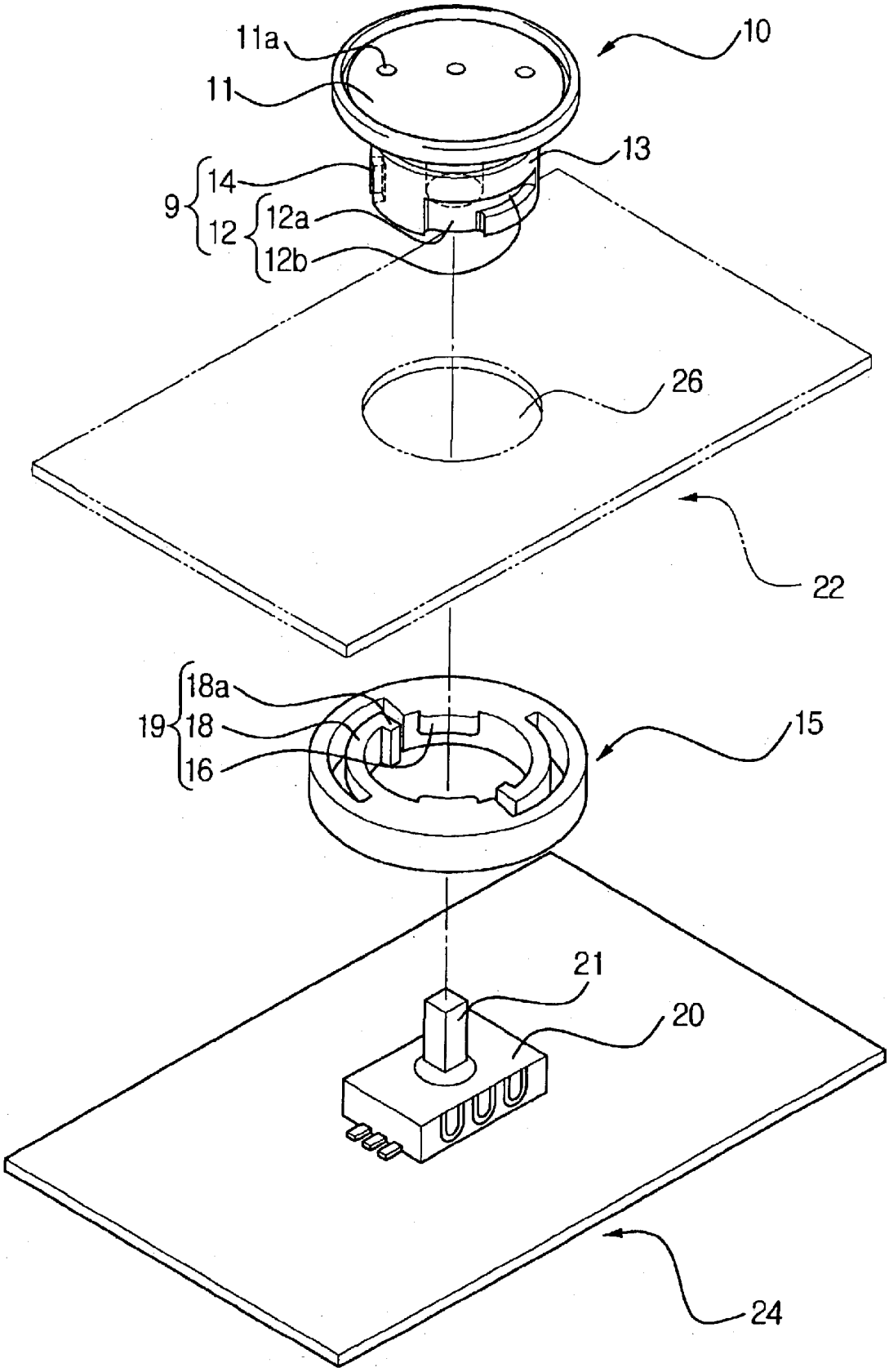
FIG. 2 is a perspective view showing a navigation switch assembly according to the present invention

FIG. 2 is a perspective view showing a navigation switch assembly according to an embodiment of the present invention. As shown in FIG. 2, the navigation switch assembly comprises a navigation switch 20, a knob 10, a holder 15, a first connecting portion 9, and a second connecting portion 19.

The navigation switch 20 is secured to a printed circuit board (PCB) 24 that is installed in a product casing 22, and has an adjustment stick 21 protruding from an upper portion thereof in a shape of a pillar. As illustrated in FIG. 2, adjustment stick 21 is rectangular in shape when viewed from the side and square in shape when viewed from above. However, embodiments of the present invention are not limited to such a shape, as the adjustment stick 21 can be any shape, such as a cylinder, a cone, a pyramid, etc.

The knob 10 has a pressing plate 11 having a friction opening 11*a* for preventing a sliding thereon, and a cylindrical hollow shaft 13 comprising the first connecting portion 9 formed at a lower side.

The holder 15 comprises the second connecting portion 19 formed inside, and is connected to the knob 10 in the product casing 22 by the first connecting portion 9.

The first connecting portion 9 comprises a pair of guide grooves 12 and a pair of locking grooves 14 that are formed along a circumference of the hollow shaft 13 disposed at the lower side of the knob 10, each pair being opposed to each other. The second connecting portion 19 comprises a pair of ribs 16 and a pair of tension ribs 18 that are formed in the inner side of the holder 15, each pair being opposed to each other. In another embodiment, more or less than a pair of guide grooves 12, more or less than a pair of locking grooves 14, more or less than a pair of ribs 16, and more or less than a pair of tension ribs 18 may be used.

As shown in the drawings, each guide groove 12 has a vertical guide groove 12*a* and a horizontal guide groove 12*b* connected with an upper end of the vertical guide groove 12*a*. Each locking groove 14 is formed in a vertical shape. Each rib 16 protrudes from the holder 15 toward a center, and each tension rib 18 protrudes from the holder 15 in a circumferential direction with a long length.

Figure 3A:
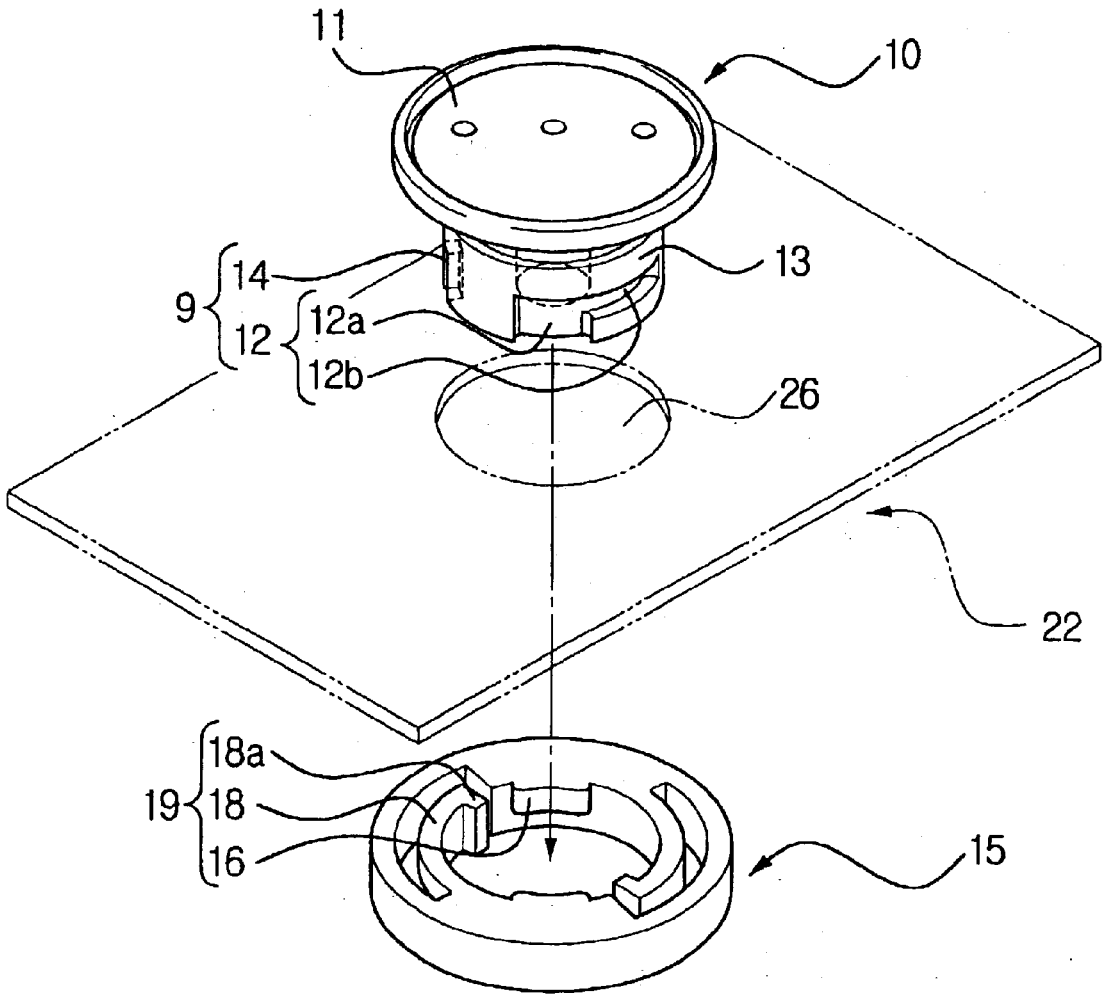
FIGS. 3A and 3B are perspective views showing a connecting portion as a main part of the navigation switch of FIG. 2.
Figure 3B:
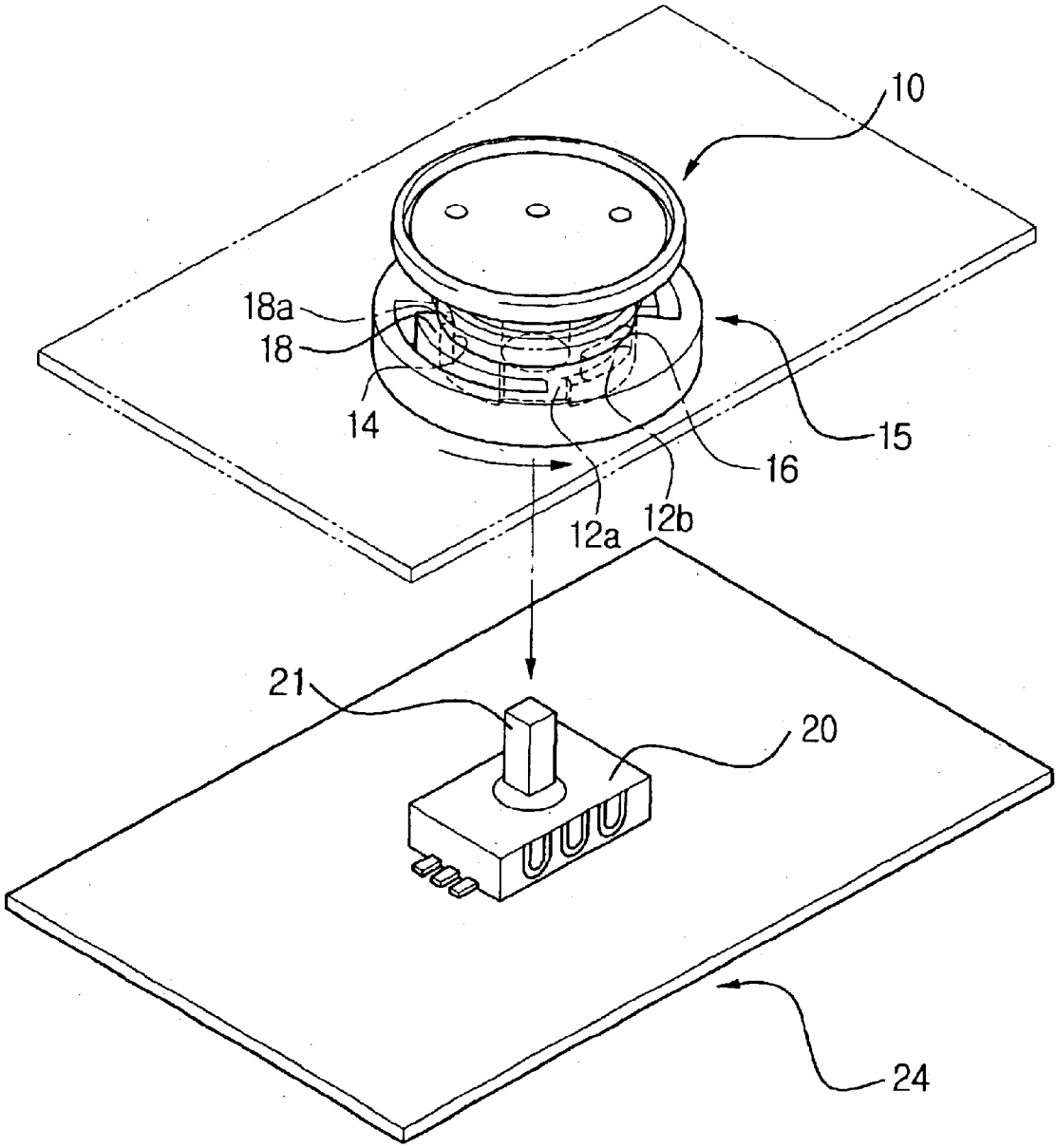

FIGS. 3A and 3B are perspective views showing the first connecting portion 9 and the second connecting portion 19 as a main part of the present invention.

Referring to FIG. 3A, the hollow shaft 13 disposed at the lower side of the knob 10 is inserted through the mounting opening 26 formed in the product casing 22 inwardly and is connected to the holder 15 in the product casing 22.

Hereinbelow, the connecting relationship of the knob 10 and the holder 15 will be described in more detail.

The hollow shaft 13 is inserted into the holder 15 such that the pair of ribs 16 formed in the holder 15 and being opposed to each other are fitted in the pair of the vertical guide grooves 12*a* formed in the circumference surface of the hollow shaft 13 and opposed to each other. At this point, because the outer diameter of the hollow shaft 13 is larger than the inner diameter of the holder 15, the pair of the tension ribs 18 disposed in the holder 15 are pushed apart from each other slightly.

Next, as shown in FIG. 3B, when the holder 15 is rotated in the rightward direction with the knob 10 being held in its inserted position, the ribs 16 are moved along the horizontal guide grooves 12*b* in a circumferential direction with the locking protrusions 18*a* protruding from ends of the tension ribs 18 being fixedly inserted into the locking grooves 14. In another embodiment, horizontal guide grooves 12*b* are positioned on the other side of vertical guide grooves 12*a*, such that when the hollow shaft 13 is inserted into holder 15, the holder 15 is rotated in the opposite circumferential direction.

After the connection of the knob 10 and the holder 15, the adjustment stick 21 protruding from the upper portion of the navigation switch 20 is inserted into the hollow shaft 13 to complete the navigation switch assembly.

The knob 10 that is connected to the holder 15 in the above-described process is prevented from shaking side-toside due to the presence of the ribs 16 fitted in the guide grooves 12. The knob 10 is also prevented from shaking up and down due to the presence of the locking protrusions 18*a* inserted in the locking grooves 14.

Also, because the holder 15 tightly holding the knob 10 is caught by the product casing 22, the knob 10 is prevented from being separated from the product casing 22 to the outside even if a user pulls the knob 10 outward.

Also, there is no reason to assemble the product casing 22 in the final step of the assembly process, because the knob 10 and the holder 15 are fabricated and assembled with each other separately from the product casing 22 and the knob 10 does not have a wing part like the conventional art. That is, after simply inserting the hollow shaft 13 disposed at the lower portion of the knob 10 inwardly the product casing through the mounting portion 26, the knob 10 is connected to the holder 15 in the product casing.

According to the assembly process of the navigation switch assembly, a shape of the knob can be designed in various ways regardless of the size and shape of the mounting opening 26. Also, because the holder 15 is connected to the knob 10 in the product casing, the wing part in the prior art is not required for the knob 10.

Figure 4:
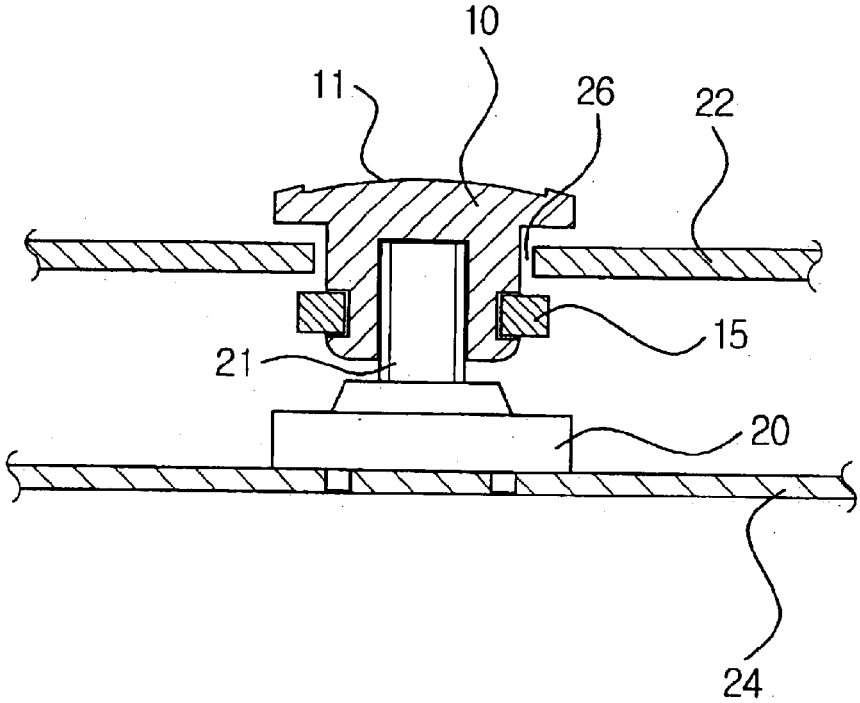
FIG. 4 is a section view showing a navigation switch assembly according to an embodiment of the present invention.

Referring to FIG. 4, it is shown that an upper shape of the knob 10 is larger than the mounting opening 26. Other elements are identical to those of the above-described embodiment.

Figure 5:
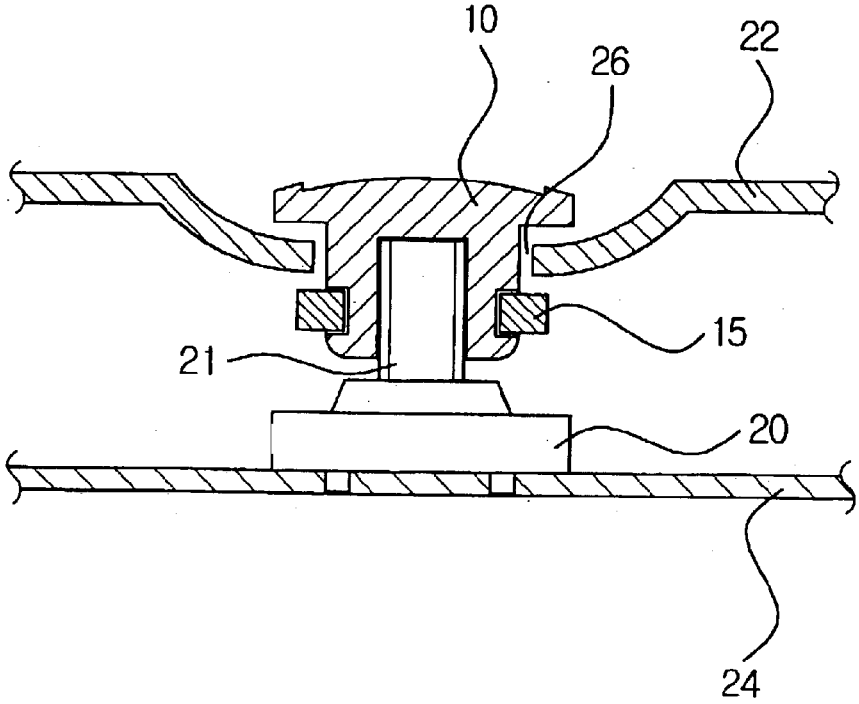
FIG. 5 is a section view showing a navigation switch assembly according to another embodiment of the present invention.

FIG. 5 is a sectional view showing a navigation switch assembly according to another embodiment of the present invention. As shown in FIG. 5, the product casing 22 is shaped to have a concave surface formed around the mounting opening 26, and a height of the knob 10 is equal to that of the product casing 22. In another embodiment, the height of the knob 10 is higher than that of the product casing 22.

The present invention should not be limited to the described preferred embodiments, but various changes and modifications can be made within the spirit of the present invention, the scope of which is defined in the claims and their equivalents. For example, the knob 10 of the present invention does not have the wing part like the conventional art and accordingly is capable of being shaped in the various configurations, such as triangular and rectangular shapes.

What is claimed is:

1. A navigation switch assembly, comprising:

a navigation switch mounted on a printed circuit board, comprising:

an adjustment stick protruding from an upper portion thereof;

a knob, comprising:

a first connecting portion, and a holder, comprising:

a second connecting portion, wherein the first connecting portion is to connect to the second connecting portion and to the adjustment stick.

2. The navigation switch assembly of claim 1, wherein the first connecting portion comprises:

a pair of guide grooves and a pair of locking grooves, each pair of grooves being formed along an external circumference of a hollow shaft disposed at a lower end of the knob, and wherein the second connecting portion comprises:

a pair of ribs and a pair of tension ribs, each pair of ribs being formed along an inner surface of the holder.

3. The navigation switch assembly of claim 2, wherein:

each of the guide grooves has a vertical guide groove and a horizontal guide groove connected to an end of the vertical guide groove, each of the locking grooves has a vertical shape, each of the ribs protrudes from the holder toward a center, each of the tension ribs protrudes from the holder along a circumference direction with a long length and has a locking protrusion formed at an end thereof, and the hollow shaft is fitted in the holder in a vertical direction such that the ribs are inserted into the vertical guide grooves and then the holder is rotated in a circumferential direction such that the ribs are moved to the horizontal guide grooves simultaneously with the locking protrusion being connected with the locking grooves.

4. The navigation switch of claim 2, wherein the holder is larger than the opening.

5. The navigation switch of claim 2, wherein an upper portion of the knob is larger than the opening.

6. The navigation switch of claim 2, wherein the casing is shaped to have a concave surface formed around the opening, and wherein a height of the knob is equal to that of a surface other than the concave surface.

7. The navigation switch of claim 2, wherein the casing is shaped to have a concave surface formed around the opening, and wherein a height of the knob is higher than that of a surface other than the concave surface.

8. The navigation switch of claim 1, further comprising:

a product casing, comprising:

an opening through which the first connecting portion passes to connect to the second connecting portion.

9. The navigation switch assembly of claim 1, wherein the knob further comprises:

a pressing plate to press the knob towards the switch to activate the switch.

10. The navigation switch assembly of claim 9, wherein the pressing plate comprises;

a friction opening to prevent sliding.

* * * * *